US007481752B2

(12) United States Patent
Garner

(10) Patent No.: US 7,481,752 B2
(45) Date of Patent: Jan. 27, 2009

(54) ABDOMINAL EXERCISE MACHINE

(75) Inventor: Brian A. Garner, Waco, TX (US)

(73) Assignee: Baylor University, Waco, TX (US)

( * ) Notice: Subject to any disclaimer, the term of this patent is extended or adjusted under 35 U.S.C. 154(b) by 0 days.

(21) Appl. No.: 11/542,048

(22) Filed: Oct. 3, 2006

(65) Prior Publication Data

US 2008/0096742 A1 Apr. 24, 2008

(51) Int. Cl.
*A63B 21/008* (2006.01)
*A63B 23/02* (2006.01)

(52) U.S. Cl. ..... 482/140; 482/112

(58) Field of Classification Search ..... 482/140, 482/121, 130, 51, 91–94, 98–100, 111–113, 482/133–137, 142; 601/23, 24; D21/687; *A63B 21/008, A63B 23/02*

See application file for complete search history.

(56) References Cited

U.S. PATENT DOCUMENTS

| | | | | |
|---|---|---|---|---|
| 4,275,882 | A | 6/1981 | Grosser et al. | |
| D271,603 | S | 11/1983 | Berner | |
| 4,426,077 | A | 1/1984 | Becker | |
| 4,429,871 | A | 2/1984 | Flechner | |
| 4,477,071 | A | 10/1984 | Brown et al. | |
| 4,618,140 | A | 10/1986 | Brown | |
| 4,618,144 | A | 10/1986 | Gibson | |
| 4,627,610 | A | 12/1986 | Ishida et al. | |
| 4,736,944 | A | 4/1988 | Johnson et al. | |
| 4,786,051 | A | 11/1988 | Mullican | |
| 4,880,227 | A | 11/1989 | Sowell | |
| 5,031,905 | A | 7/1991 | Walsh | |
| 5,037,090 | A | 8/1991 | Fitzpatrick | |
| 5,058,888 | A | 10/1991 | Walker et al. | |
| 5,277,684 | A | 1/1994 | Harris | |
| 5,352,171 | A | 10/1994 | Lin | |
| 5,419,750 | A | 5/1995 | Steinmetz | |
| 5,595,558 | A | 1/1997 | Moon | |
| 5,605,524 | A | 2/1997 | Husted | |
| 5,665,034 | A | 9/1997 | Hwang | |
| 5,685,810 | A | 11/1997 | Chung | |
| 5,743,832 | A | 4/1998 | Sands et al. | |
| 5,776,084 | A * | 7/1998 | Wolan | 601/26 |
| 5,785,635 | A | 7/1998 | Gerschefske et al. | |
| 6,113,522 | A * | 9/2000 | Fontenot et al. | 482/111 |
| 6,290,630 | B1 | 9/2001 | Boland | |
| 2002/0193210 | A1 | 12/2002 | Tuner | |
| 2006/0166799 | A1 * | 7/2006 | Boland et al. | 482/140 |
| 2006/0211549 | A1 * | 9/2006 | Nohejl | 482/97 |

* cited by examiner

*Primary Examiner*—Loan H Thanh
*Assistant Examiner*—Oren Ginsberg
(74) *Attorney, Agent, or Firm*—Jackson Walker, LLP

(57) ABSTRACT

An exercise machine, more specifically, an abdominal exercise machine. The abdominal exercise machine consists of a frame upon which the user sits, the frame having a support arm tilted backward from vertical with the lower lumbar region against a seat member. Pivotally attached to the frame is an upper seat rest assembly that has a pair of handles and a pad designed to lay against the upper back of the user. The seat back assembly moves with the upper body of the user, the hands of the user assisting in maintaining the upper seat back member against the upper back, while the user moves from a tilted back position to a crunch position, and simulating a traditional sit-up movement.

10 Claims, 7 Drawing Sheets

ABDOMINAL EXERCISE MACHINE

FIELD OF THE INVENTION

Exercise machines, more specifically, an exercise machine designed to exercise the abdominal muscles.

BACKGROUND OF THE INVENTION

An important feature to help in good health, longevity is regular, proper exercise. Exercise may take a number of forms. Exercise may be done through calisthenics, through the use of free weights for providing resistance, or through the use of exercise machines. Exercise machines are often very useful for effective exercise, if they are properly designed and used. They may, for example, focus on a specific set of muscles and a range of movement through an exercise cycle. They may also provide for adjustment of resistive forces, so as to accommodate different users or the changing requirements of a single user.

Exercise machines have been designed to exercise the abdominal muscles. For example, muscles of the abdominal wall, including rectus abdominis, internal oblique and external oblique muscles of the abdominal region, may be beneficially exercised by what can generally described as a sit-up or "crunch" type motion wherein an angle defined by the longitudinal axis of the upper torso and the thighs is varied during the act of contraction and relaxation of the abdominal muscles. Done without free weights or machines, the sit-up style crunch exercise is typically done with the user holding his knees and feet in the air and crunching up to bring his nose toward the knees.

Free weights may be used for sit-up exercise by, for example, the exerciser clutching a light weight to the chest area during the performance of the sit-up.

The abdominal exercise machines typically position the user on the machine to provide limited movement of the limbs but a range of movement of the torso, while providing some form of resistance. The resistance is typically provided through weights, springs, pulleys and, in some cases, a hydraulic or pneumatic cylinder.

The aim of an exercise machine should be to provide the proper amount of resistance through the proper range of motion while maintaining proper body position, so as to provide a most beneficial movement with a minimal risk of harm. Harm can result from exercises done improperly or without proper resistance forces. Sloppy technique or too much weight in using an abdominal machine may result in injury to the muscles, such as a pulled muscle or hernia.

Sometimes an exercise machine is designed to emulate a certain movement, for example, a sit-up style crunch. Sometimes exercise machines are designed to provide a level of resistance that is more suitable to one category of users, say women or children, rather than the athletes. A view of the prior art of abdominal exercise machines reveals a deficiency in at least one or more design objectives set forth herein: proper position of the body of the user through a proper range of motion, and the use of a proper resistance force. Prior art exercise machines either do not properly define the objectives or, if the objectives were defined, have not adequately addressed these objectives.

The prior art abdominal machines tend to use an adjustable weights stack, the user's body weight, elastic members or hydraulic/pneumatic cylinder mechanisms to provide resistance. However, the prior art abdominal exercise machines do not provide for a balanced combination of the user's body weight with the advantages of hydraulic and/or pneumatic resistance. As such, Applicant has endeavored to provide an effective, efficient and safe abdominal exercise machine to achieve proper body position and the proper application of resistance force over a range of motion suitable for the effective exercise of the target muscle groups.

OBJECTS OF THE INVENTION

It is an object of Applicant's present invention to provide an exercise machine to exercise the abdominal muscles which will provide for the balanced application of a resistance force over the proper range of motion, specifically with the needs of non-athletic women in mind.

It is another object of the present invention to provide an exercise machine which, while focusing on abdominal muscles, is also capable of facilitating multiple body positions for targeting specific muscles within the abdominal group.

SUMMARY OF THE INVENTION

This and other objects are provided in an abdominal exercise machine that uses a balanced combination of the user's body weight and hydraulic (or pneumatic) resistance. The user's objectives may be achieved in an abdominal exercise machine which consists of a fixed base, including a seat and a lower back (lumbar) support and a pivotally attached upper backrest which rotates about a pair of hinge mounts located to either side of the seated user. The axis of the hinged mount runs horizontally from side-to-side through the lower lumbar region of the seated user in alignment with the user's pivot axis for a sit-up style crunch style exercise.

This and other objects are provided in the above described machine, further including a pair of handles which rise upward and outward alongside the user's head, to be grasped by the user during the movement of the upper backrest through the simulated crunch style exercise.

This and other objects are provided in an exercise machine as set forth in the paragraphs above, further including a hydraulic and/or pneumatic device typically attached behind the user to span between the fixed base and the upper backrest and provide resistance as the backrest is rotated by the user. The user is normally seated against the backrest lumbar support and seat, and grasping the handles alongside the head performs the cyclic exercise motion involving the contraction of abdominal muscles to pull the backrest, along with the torso, up and forward.

This and other objects are provided in an exercise machine, wherein the seat, lumbar support and backrest are angled so that in the starting position, gravity tends to pull the user backward against the backrest and thus provides resistance against the crunch exercise movement. However, the backward tilting angle decreases as the user, approximately halfway through the range of motion, has moved "over the top" so that gravity begins to work in the direction assisting the user to pull the torso forward and downward (e.g., center of gravity "falling").

This and other objects are achieved in the exercise machine set forth herein, wherein the cylinder is positioned so as to provide minimal resistance at the start of the forward crunch stroke and to gradually increase resistance as the stroke progresses over the top. In this way, both gravity and the cylinder combine to provide an effective level of resistance over the range of motion taking into account the effect of the weight of the upper torso of the user's body over the range of motion and the speed at which the exercise is performed.

This and other objects are provided in the exercise machine, which includes a seat with a perimeter which is semi-circular or delta in shape so as to permit the user to sit, with torso facing forward, but with the legs in a range of positions from straight forward to angled to either side, thus emphasizing exercise of the internal/external oblique muscles, and thus providing versatility in a design that permits a single machine to be used to work different muscle groups within the abdominal region.

BRIEF DESCRIPTION OF THE DRAWINGS

FIG. 2D shows an embodiment wherein an elastic member provides resistance.

DETAILED DESCRIPTION OF THE PREFERRED EMBODIMENT

Figure 1:
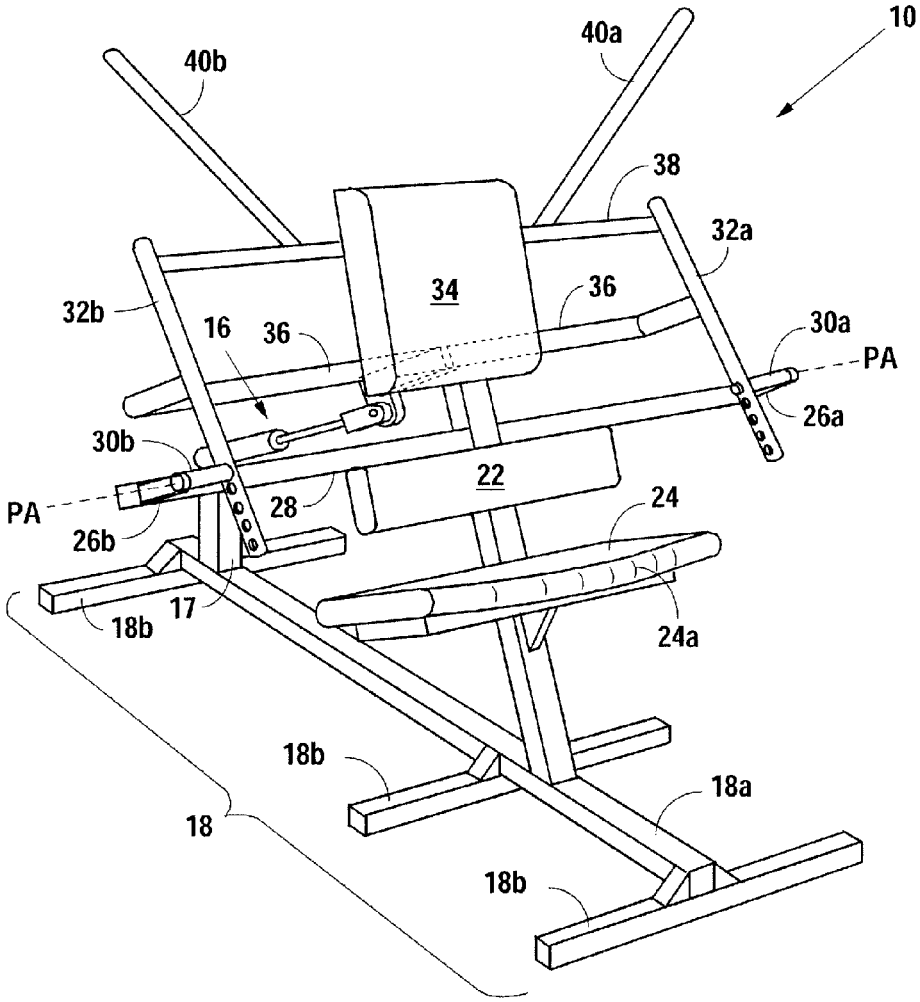
FIG. 1 is a perspective view of Applicant's abdominal exercise machine.

With reference to the Figures, it is seen that Applicant provides an abdominal exercise machine 10 comprising two components, one pivotal about the other, the two components attached through the use of a cylinder assembly. Here, it is seen that Applicant provides a rigid, stationary, floor mounted frame assembly 12 to which is engaged a pivoting upper seat back assembly 14. Frame assembly 12 and pivoting seat back assembly 14 are engaged to one another through a piston/cylinder assembly 16. Frame base 18 is designed to provide secure support for the exercise machine against a base, such as a floor. Frame base 18 may be seen to comprise at least one longitudinal member 18*a* and, typically, a multiplicity of lateral members 18*b* (here, three shown). The lateral members typically provide lateral support, as well as vertical support, to the seated user in the abdominal exercise machine set forth more fully below.

A support arm 20 is seen in the side elevational views to transcribe an acute angle with respect to the plane of the horizontal support surface, at the angle, for example, in between 45 and 89 degrees above horizontal. Moreover, the support arm 20 is seen to provide support structure for a number of components more specifically set forth below. While a single support arm is shown, two or more could be utilized or a tabular member may be provided, which Applicant intends to be included within the term "support arm."

Figure 3:
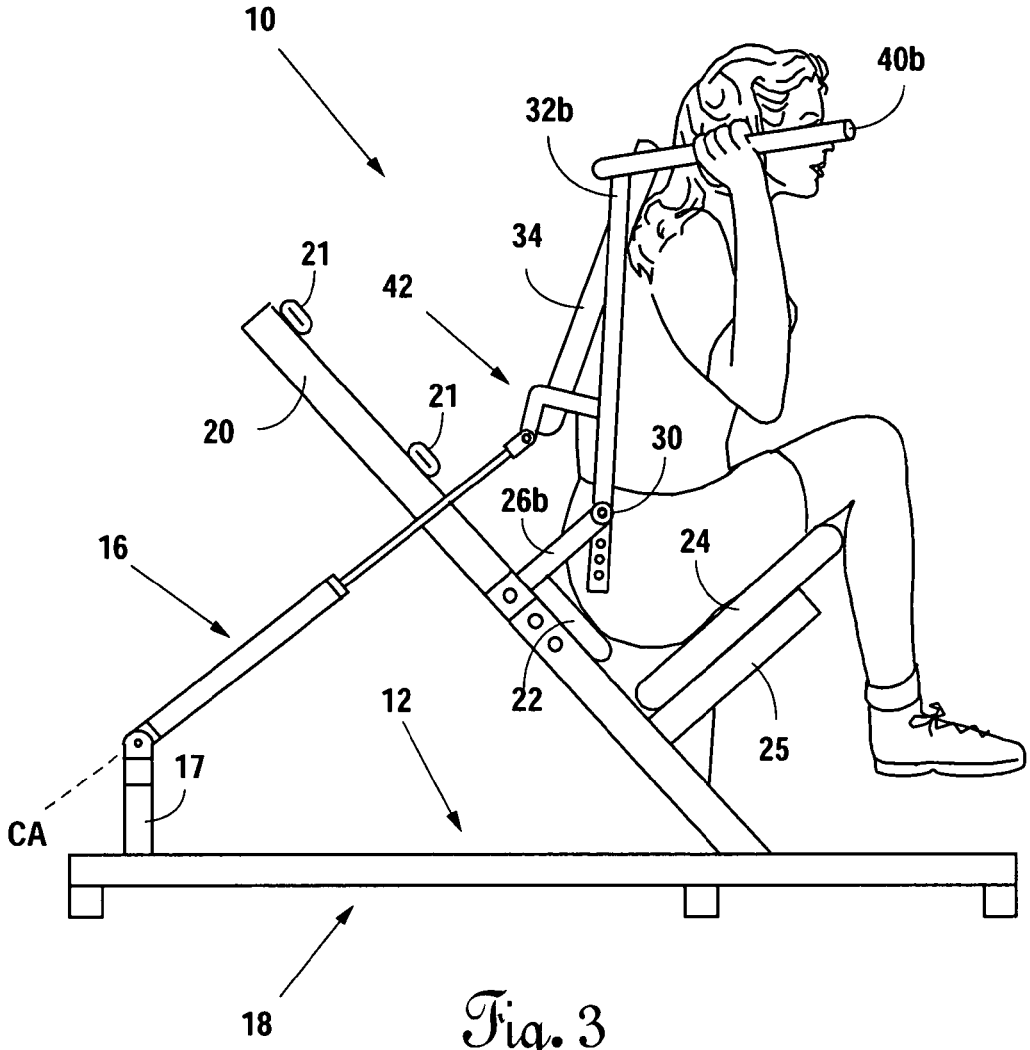
FIG. 3 illustrates a user on the abdominal exercise machine just after the user has gone over the top and that is just past the position illustrated in FIG. 2B.
Figure 4:
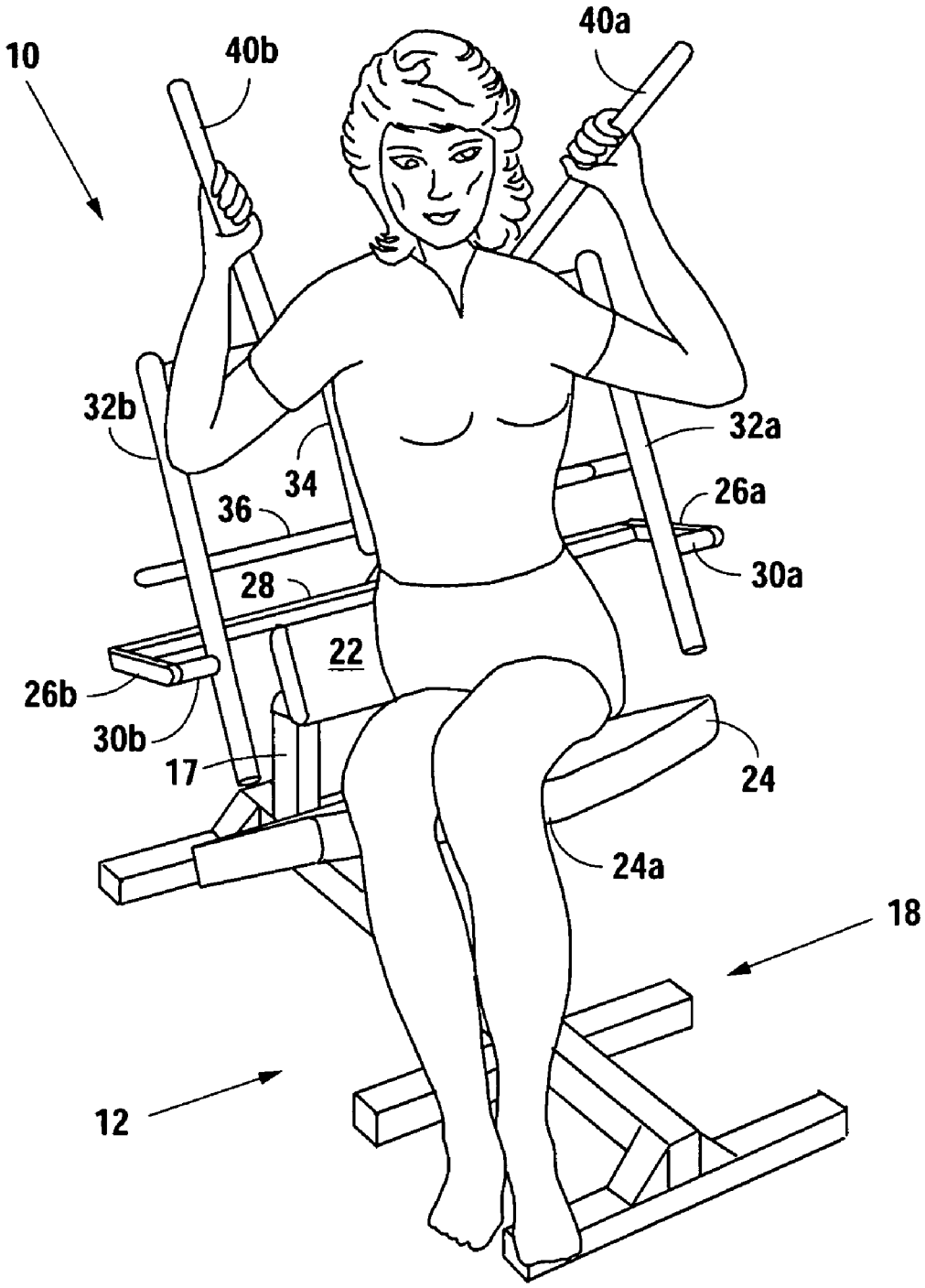
FIG. 4 illustrates a user with legs shifted to one side.

More specifically, it is seen that support arm 20 supports a lumbar support 22, in the form of a tabular padded member laying in the plane of the support arm and above a seat member 24, which may be disposed generally perpendicular, but is preferably disposed at an angle greater than 90 degrees and most preferably between 100 to 110 degrees to the plane of support arm 20 and below the lumbar support to provide for significant support to the bottom and upper thighs of the user as illustrated in FIG. 3. Seat member 24 is typically padded in a manner known in the art, but has a leading edge 24*a* that is curved to allow the user to more easily assume positions set forth in FIG. 4, for example, and thus focus on different muscle groups than if the user were in position as set forth in FIG. 3, for example.

A pair of spaced apart pivot arm standoffs 26*a*, 26*b* are provided spaced apart to either side of support arm 20, as best seen in FIG. 1, through the use of pivot arm location member 28, which is rigidly attached to support arm 20 and extends from either side thereto. Through the use of pivot arm location member 28 and a pair of pivot arm standoffs 26*a*, 26*b*, seat back assembly 14 may be pivotally attached to frame assembly 12 through the use of, for example, bearing assemblies 30*a*, 30*b*.

Turning now to the nature of the pivoting seat back assembly, it is seen to comprise uprights 32*a*, 32*b*, which are attached to the bearing assemblies, the uprights include typically a pair of cross members here 36 (lower) and 38 (upper), the cross members locating upper back support member 34, which is typically tabular and padded and set in a position aligned, or nearly aligned, with the support arm 20 when seat back assembly 14 is in the starting position. A pair of handles 40*a*, 40*b* are typically provided moving up and forward from the plane of back support member 34, as seen, for example, in FIG. 2B. Piston assembly engagement bracket 42 is provided having a near end 42*a* and removed end 42*b*. The near end 42*a* may be located and rigidly attached to one or more members of seat back assembly 14, but here is seen attached to cross member 36. It is seen here that piston assembly engagement bracket 42 is provided to engage piston cylinder assembly 16. More specifically, it is seen that piston cylinder assembly 16, which may optionally engage one or more members of frame assembly 12 for the use of a vertical standoff 17, is comprised of a cylinder 16*a* and a rod member 16*b*. It is attached at the removed end of the rod and at the removed end of the cylinder to the frame assembly 12 and pivoting seat back assembly 14 and frame assembly 12, respectively, so they are engaged one to the other.

Figure 2A:
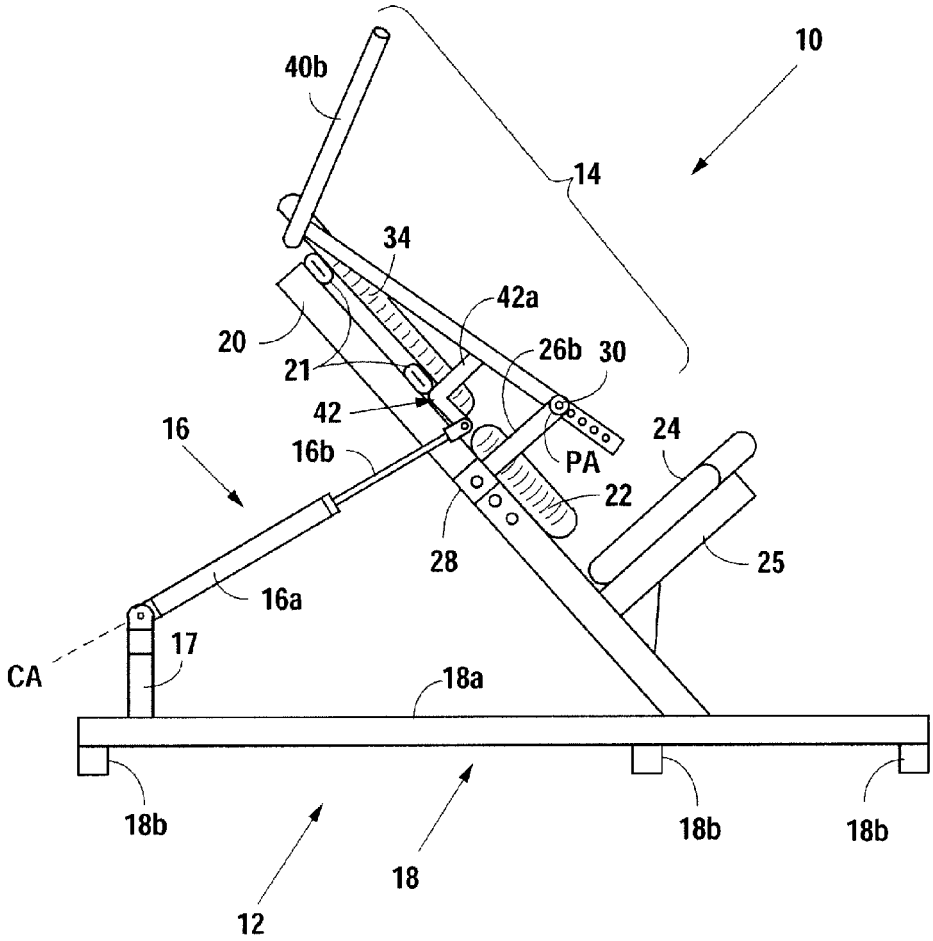
FIGS. 2A, 2B, 2C, and 2D are side elevational views of Applicant's abdominal exercise machine showing the position of the upper seat backrest with respect to the frame assembly in a user's start (FIG. 2A), over the top (FIG. 2B), and end positions (FIG. 2C) as the user simulates a crunch style abdominal exercise.
Figure 2B:
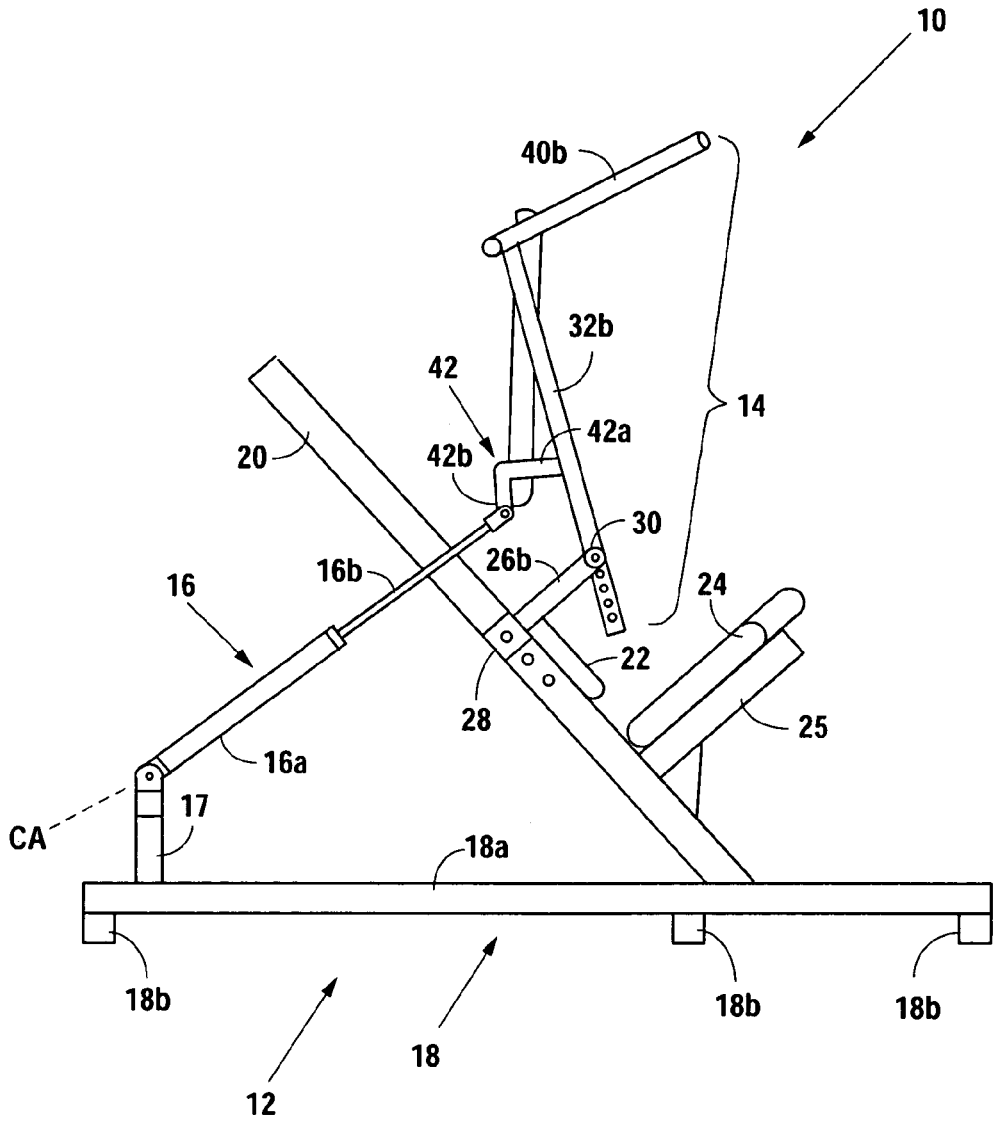

Further detail of Applicant's abdominal exercise machine 10 may be appreciated with reference to FIGS. 1, 2B, and 3 defining an axis on which the seat back assembly 14 pivots with respect to the frame. This pivot axis is located in the lower abdominal region of the user as the user is seated and located on seat member 24 and lower lumbar support member 22. Thus the seats properly position the user's lower torso during exercise movement while user's hands are located on the handles holding the pivoting seat back assembly with the upper back support member 34 against the upper back. The use of the combination of a properly positioned seat and lower lumbar support and pivoting axis, as well as a properly positioned upper back support member on the pivoting back assembly, will help maintain the proper position of the user throughout the range of movement in the crunch style abdominal exercise.

Figure 2C:
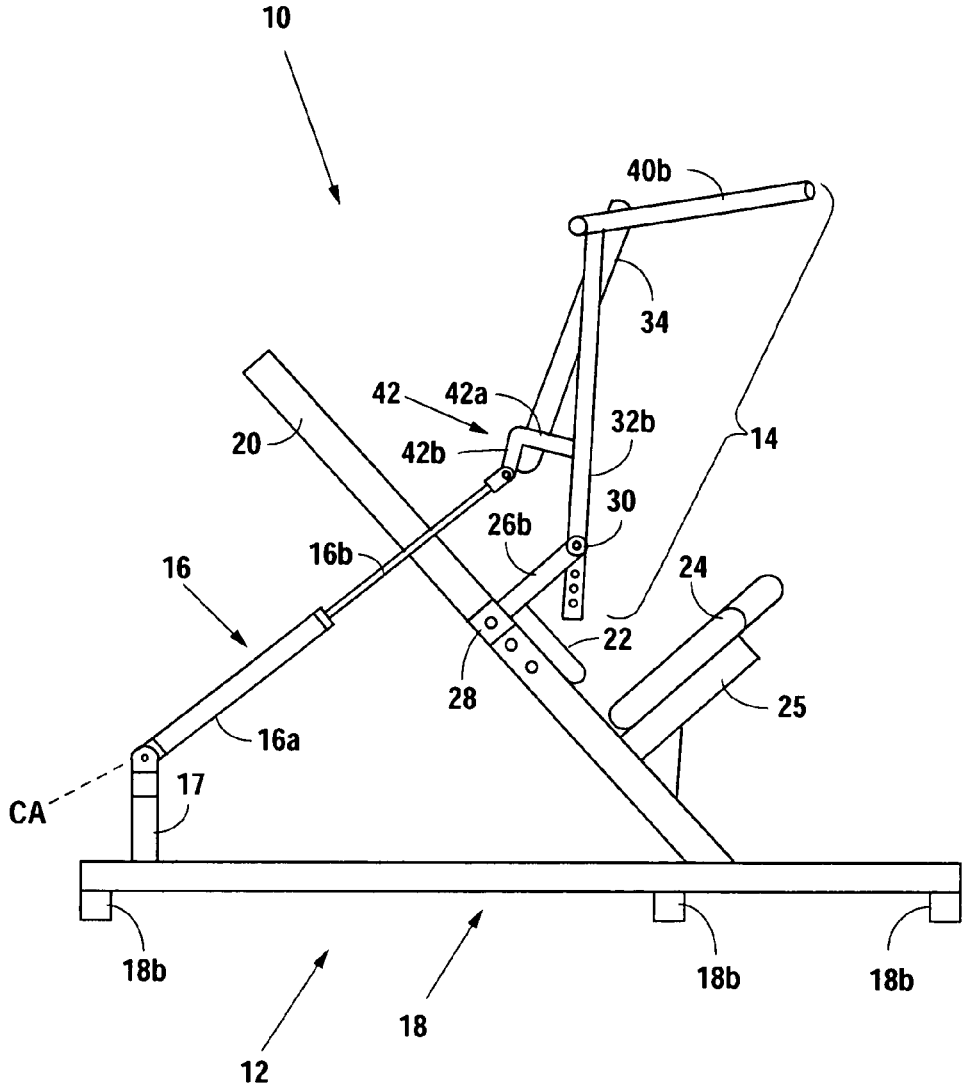
Figure 2D:
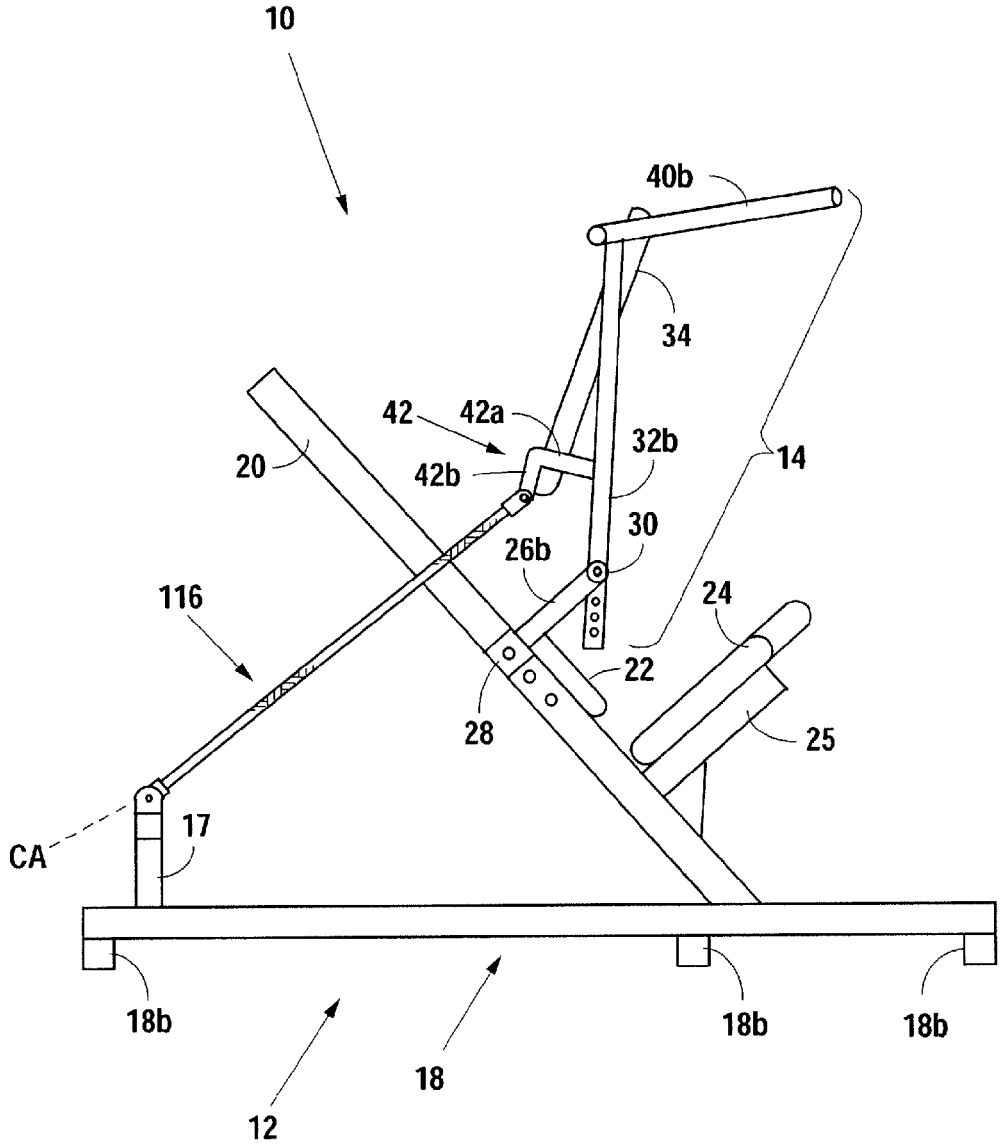

Another advantage of Applicant's abdominal exercise machine 10 may be appreciated with reference to the longitudinal cylinder axis CA as illustrated in FIG. 2B. To appreciate the preferred positioning of piston cylinder assembly 16 with respect to frame assembly 12 and pivoting seat back assembly 14, reference is made in FIGS. 2A, 2B, and 2C, with further reference to the location of removed end 42*b* of piston assembly engage bracket 42, and noting more specifically how removed end 42*b* locates the end of rod 16*b* with respect to the pivot axis PA.

It is further seen that the movement of removed end 42*b* is a partial fixed radius arc about pivot axis PA. Second, it may be appreciated with reference to FIG. 2A, that in the initial start position, cylinder axis CA is aligned almost so that it actually or nearly intersects pivot axis PA at a distance being in the most preferred embodiment between about 0 cm and about 3 cm. Therefore, initial movement of the backrest along the arc only minimally extends the rod, whereas the same distance of movement over the top extends the rod to a greater degree. Thus, as the user moves from the position illustrated in FIG. 2A, through the top as illustrated in FIG. 2B and approaches the position in FIG. 2C, the resistance provided by the cylinder moves from a minimum to a maximum to the top of the arc back to a minimum. Over the same range of motion, the user's torso center of gravity moves from a position behind, to above, and then in front of the PA. As a result, the force of gravity varies from one of resisting to one of slightly assisting the forward crunch exercise motion. Thus, the increasing cylinder resistance works in concert with the decreasing gravity resistance to provide a balanced effect over the range of motion. At or near the position shown in FIG. 2C, the perpendicular distance from PA to CA approaches maximum, typically about 20 cm. Thus, the preferred range of distance between the CA and PA (measured along the perpendicular) is 0 cm at the closest to about 20 cm at the greatest Turning to FIG. 4, it is seen that the user may position herself in position similar to FIG. 3, with respect to the lower back and upper seat back position, but may rotate the legs to either side and emphasize the contraction of the internal and external oblique muscles to either side of the rectus abdominis muscle set. The use of the position seen in FIG. 4, or its counterpart to the opposite side, is facilitated through the use of a curved leading edge 24*a* about the perimeter of seat 24.

The use of resistance in the form of a piston and cylinder assembly, either hydraulic or pneumatic, is preferred as is the position of the cylinder with respect to the arc of movement of the upper back rest assembly 14, so as to balance the increasing resistance force of the cylinder against the decreasing resistance force of the weight of the upper torso through the range of motions indicated. However, an elastic member 116 or members may be used in place of the piston and cylinder assembly. Thus the term resistance assembly is used to include elastic member(s) 116 or pneumatic or hydraulic cylinders, these structures for the application of a mechanical resistance. The elastic member(s) 116 would attach between the frame and seat back assembly so that there is, when in the back position, some optional but preferable nominal tension in the elastic member 116.

Although the invention has been described with reference to specific embodiments, this description is not meant to be construed in a limited sense. Various modifications of the disclosed embodiments, as well as alternative embodiments of the inventions, will become apparent to persons skilled in the art upon the reference to the description of the invention. It is, therefore, contemplated that the appended claims will cover such modifications that fall within the scope of the invention.

The invention claimed is:

1. An abdominal exercise machine comprising:

a frame assembly with a seat and a lumbar support attached thereto, the seat and lumbar support statically positioned with respect to the frame assembly, the frame assembly at a tilted position and having a support arm;

a seat back assembly pivotally attached to the frame assembly at a pivot axis, the seat back assembly with an upper back support member, the seat back assembly adapted to pivot on the pivot axis from a rest position where the upper back support member is tilted back from vertical to a tilt forward position when the upper back support member is past vertical and wherein the pivot axis is positioned above the seat within a user's lower lumbar area at a point forward of and perpendicular to the frame assembly; and a piston and cylinder assembly attached between the frame assembly and the seat back assembly and having a longitudinal axis;

wherein the support arm is adapted to position the upper back support members in the rest position; and wherein the upper back support member is in generally the same plane as the plane of the lumbar support when in the rest position;

wherein the longitudinal axis of the piston and cylinder assembly is close to the pivot axis when the seat back assembly is in the tilt back position;

wherein the piston and cylinder assembly is attached between the frame assembly and the seat back assembly by means of an angled bracket, such that as the seat back assembly moves to the tilt forward position, the distance between the longitudinal axis of the piston cylinder assembly and the pivot axis increases;

wherein the pivot axis is adapted to be positioned in a lower lumbar area of the user when the user is seated on the frame assembly against the seat and lumber support;

wherein the seat has a perimeter that has a leading edge adapted to accommodate a range of swiveled hip positions; and wherein the seat back assembly further includes hand members.

2. The abdominal exercise machine of claim 1, wherein the support arm includes a resilient stop for receiving the seat back assembly thereon.

3. The abdominal exercise machine of claim 1, wherein the frame assembly includes a base and wherein the support arm is engaged to the base at an angular position in the range of about 45° to about 89°.

4. The abdominal exercise machine of claim 1, wherein the piston and cylinder assembly is hydraulic.

5. The abdominal exercise machine of claim 1, wherein the piston and cylinder assembly is pneumatic.

6. The abdominal exercise machine of claim 1 wherein the seat back assembly includes a multiplicity of cross members to support the upper back support member.

7. The abdominal exercise machine of claim 1, further including a bearing assembly for engaging the seat back assembly to the frame assembly.

8. The abdominal exercise machine of claim 1, wherein the frame assembly further includes a standoff for mounting the piston and cylinder assembly thereto.

9. An abdominal exercise machine comprising:

a frame assembly with a seat and a lumbar support attached thereto, the seat and lumbar support statically positioned with respect to the frame assembly, the frame assembly at a tilted back position and having a support arm;

a seat back assembly pivotally attached to the frame assembly at a pivot axis, the seat back assembly with an upper back support member, the seat back assembly for pivoting with respect to the support arm from a back position where the upper back support member is tilted back from vertical to a tilt forward position when the upper back support member is past vertical and wherein the pivot axis is positioned above the seat within a user's lower lumbar area at a point forward of and perpendicular to the frame assembly; and a resistance assembly attached between the frame assembly and the seat back assembly and having a longitudinal axis;

wherein the support arm is adapted to support the seat back assembly in the rest position;

wherein the upper back support member is about parallel to the plane of the lumbar support when in the rest position;

wherein the resistance assembly comprises a piston and cylinder assembly;

wherein the longitudinal axis of the piston and cylinder assembly is close to the pivot axis when the seat back assembly is in the tilt back position;

wherein the piston and cylinder assembly is attached between the frame assembly and the seat back assembly by means of an angled bracket, such that as the seat back assembly moves to a tilt forward position, the distance between the longitudinal axis of the piston and cylinder assembly and the pivot axis increases;

wherein the pivot axis is adapted to be positioned in a lower lumbar area of the user when the user is seated on the frame assembly against the seat and lumbar support;

wherein the seat has a perimeter that has a leading edge adapted to accommodate a seated position with the hips swiveled;

wherein the seat back assembly further includes hand members;

wherein the frame assembly includes a base; and wherein the support arm is engaged to the base at an angular position in the range of about 45° to 89°.

10. A method of using an abdominal muscle machine method including the steps of:

providing a frame assembly with a seat and a lumbar support attached thereto, the seat and lumbar support statically positioned with respect to the frame assembly, the frame assembly at a tilted back position and having a support arm;

a seat back assembly pivotally attached to the frame assembly at a pivot axis, the seat back assembly with an upper back support member, the seat back assembly for pivoting with respect to the support arm from a back position where the upper back support member is tilted back from vertical a tilted forward position when the upper back support member is past vertical and wherein the pivot axis is positioned above the seat within a user's lower lumbar area at a point forward of and perpendicular to the frame assembly; and a resistance assembly comprising a piston and cylinder assembly attached between the frame assembly and the seat back assembly and having a longitudinal axis;

wherein the support arm is adapted to support the seat back assembly in a rest position; and wherein the upper back support member is about parallel to the lumbar support when in the rest position;

wherein the longitudinal axis of the piston and cylinder assembly is close to the pivot axis when the seat back assembly is in the tilted back position; wherein the position and cylinder assembly is attached between the frame assembly and the seat back assembly by means of an angled bracket, such that the seat back assembly moves to the tilted forward position, the distance between the longitudinal axis of the piston cylinder assembly and the pivot axis increases; wherein the pivot axis is adapted to be positioned in the lower lumbar area of the user when the user is seated on the frame assembly against the seat and the lumbar support; and wherein the seat has a perimeter that is adapted to accommodate a range of swiveled hip positions.

assuming a first seated position with the upper torso body and upper legs facing forward;

performing a multiplicity of crunch style sit-ups;

realigning the upper legs to one side or the other of said first position; and performing a multiplicity of exercise movements.

* * * * *